United States Patent [19]

Tsukamoto

[11] Patent Number: 5,008,982

[45] Date of Patent: Apr. 23, 1991

[54] CLIP

[76] Inventor: Tatsusabu Tsukamoto, No.2570 Ohaza Mukaizima, Chiyodamachi, Kanazakigun Saga-Ken, 842, Japan

[21] Appl. No.: 584,361

[22] Filed: Sep. 18, 1990

Related U.S. Application Data

[63] Continuation of Ser. No. 276,452, filed as PCT JP87/00025 on Jan. 16, 1987, published as WO88/05388 on Jul. 28, 1988, abandoned.

[51] Int. Cl.[5] ..... A44B 1/04

[52] U.S. Cl. ..... 24/67.9; 24/67.3; 24/546

[58] Field of Search ..... 24/67.9, 67.3, 67 R, 24/545, 546, 547, 548, DIG. 8

[56] References Cited

U.S. PATENT DOCUMENTS

| | | | |
|---|---|---|---|
| 1,565,501 | 12/1925 | Robinson, Jr. | 24/546 |
| 1,783,099 | 11/1930 | Ries | 24/546 |
| 3,408,700 | 11/1968 | Chase | 24/67.9 X |

FOREIGN PATENT DOCUMENTS

| | | |
|---|---|---|
| 366551 | 7/1950 | Japan . |
| 49-33920 | 3/1974 | Japan . |
| 52-3719 | 1/1977 | Japan . |
| 52-31512 | 3/1977 | Japan . |
| 55-169459 | 12/1980 | Japan . |
| 59-181781 | 12/1984 | Japan . |

*Primary Examiner*—Laurie K. Cranmer

*Attorney, Agent, or Firm*—Cushman, Darby & Cushman

[57] ABSTRACT

A clip comprising outer and inner rings (11, 12) formed to protrude forwardly in the form of rings and wound together such as to form leg portions (14,20 and 15, 21) crossing one another. The leg portion (14 or 21) having at least one of the two rings having a cut end rearwardly extends at a gentle angle to the corresponding leg portion (20 or 15) of the other ring and eventually overlaps the corresponding leg portion. The clip may clip a material without bending an end thereof, and it hardly produces a trace of clipping.

20 Claims, 1 Drawing Sheet

CLIP

This is a continuation of application Ser. No. 07/276,452, filed as PCT JP87/00025 on Jan. 16, 1987, published as WO88/05388 on Jul. 28, 1988, now abandoned.

BACKGROUND OF THE INVENTION

1. Field of the Invention

This invention relates to a clip, which is used to clip a stack of business paper sheets or like loose sheets and permits quick unclipping to separate the paper sheets when necessary.

2. Description of the Prior Art

Extensive use has previously been made of clips commonly termed Gem clips or V-shaped clips, each of which comprises inner and outer clamping loops formed to protrude forwardly in a U- or V-shaped form. In these clips, the inner and outer clamping loops lie in the same plane. Therefore, even when clipping a very thin sheet stack, the two loops are displaced from each other by at least the thickness of a wire. As a result, an adequate clipping force is produced. Further, with these clips, there is no distinction between the front and back sides, and the inner loop may be displaced from either side of the outer ring. Therefore, even if the inner loop becomes permanently displaced from one side of the outer loop, the clip is reusable with the inner loop on the other side of the outer loop.

Other clips which consist of wires include those shown in Japanese Utility Model Publication No. 366551, Japanese Utility Model Publication No. Showa 52-31512 and paper clips shown in U.S. Pat. No. 4237587. These clips have elongate overlapped clipping portions between opposing loops so that material is clipped. Since the material is sandwiched between overlapping loops, it need not be deformed, and no trace of the clip appears.

In contrast, with the aforementioned Gem clip or V-shaped clip, the inner and outer loops lie in the same plane and do not overlap. When the material is clipped, the inner loop forces the material through the center of the outer loop. Therefore, there is a possibility of bending the end of the clipped material. This drawback is particularly apparent when clipping a thin and soft material. A recess-like trace of clipping is left on the surface of the clipped material. This drawback has been pointed out from an early date, and various improvements have been proposed.

Clips shown in the Japanese Utility Model Publication No. 366551 disclose clipping the material between overlapped loops, however it is difficult to use these clips in the converse form. Besides, it is difficult to manufacture the clip so that the legs of the loops (consisting of a thin wire) are held in close contact with each other. This often results in an inadequate clipping pressure. Also, there is inevitably a loosening of the close contact. Consequently, there is a possibility that sufficient clipping force can not be obtained when clipping a sheet stack consisting of a small number of sheets.

Further, when the overlapped leg portions are separated by plastic deformation in clipping a thick material, their initial state can not easily be restored. Therefore, the clip is not well suited for clipping important documents, and can be used again only with difficulty.

SUMMARY OF THE INVENTION

An object of the present invention is to provide a clip which enables clipping of a material between overlapping clamping members, so as not to form any trace of clipping on the front or rear surface of the clipped material.

Another object is to compensate for plastic deformation of the clip with a reversible clip capable of providing sufficient clipping force again even if the close contact of overlapping portions is loosened or the overlapping portions are widely opened.

Another object of the present invention is to provide a clip which can be manufactured inexpensively like the prior art Gem clip.

According to the present invention, there is a first clamping member having a first leg and a second leg, the first leg and the second leg being connected at one end;

a second clamping member having a first leg and a second leg, the first leg and the second leg being connected at one end and diverging therefrom;

said first clamping member and said second clamping member being connected, said second clamping member superposed on said first clamping member to form a clip; and at least one of the legs of said first clamping member transverse to the respective leg of said second clamping member and defining an acute angle therewith for allowing facile superpositioning of the second clamping member on the first clamping member.

When the material is clipped between the inner and outer clamping members, a clipping force is produced in one or both of the overlapping sections at the points where opposing legs contact. The force is substantially perpendicular to the plane of the surface of the clipped material. Thus, there is no possibility of bending of an end of the clipped material or formation of a recess-like trace of clipping on the surface of the clipped material. Further, since the legs can easily be moved to the left or right, the clamping member can be readily brought to the back side of the clip by pushing it down with a finger. By so doing, the clip is usable in its converse form, and it is possible to maintain a strong clipping force at all times.

DETAILED DESCRIPTION OF THE PREFERRED EMBODIMENTS

Figure 1:
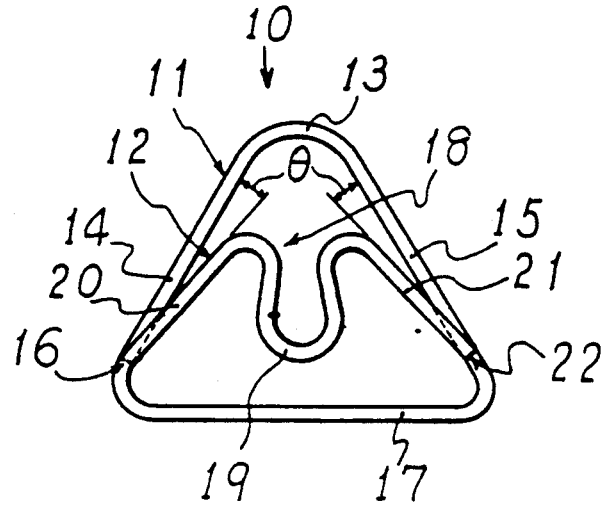
FIG. 1 is a front view showing an embodiment of the clip according to the present invention.
Figure 2:
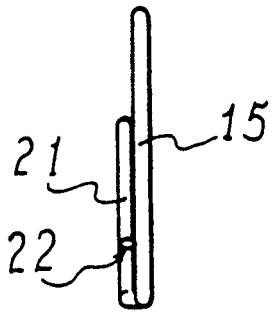
FIG. 2 is a right side view of the same clip.
Figure 3:
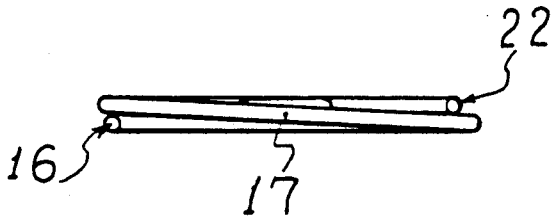
FIG. 3 is a back view of the same clip.

FIGS. 1 to 3 show a clip 10, which consists of a first clamping member 11 formed as a loop in the shape of a right triangle with rounded apices and a second clamping member 12 formed as a loop and protruding towards the center of the loop of first clamping member 11. First clamping member 11 has an apex 13 which is formed with a somewhat large radius of curvature, and also has a first leg 14 and a second leg 15 flaring away from each other like a figure V, and at an angle B. The first leg portion 14 has a cut end 16, while the second leg portion 15 has an uncut end which is bent and connects with a connecting rod 17. The second clamping member 12 is formed with a tab portion 19 adapted to provide a finger-hold, and also has first leg 20 and second leg 21 which flare away from each other to form a figure V having an angle $\alpha$ which is greater than angle B. The first leg 20 of the second clamping member 12 has an unit end united to the connecting rod 17. The second leg 21 of the second clamping member 12 has a cut end 22. When clipping wide material with this clip, the second clamping member 12 is opened from one side of the outer ring with a tab applied to the finger 19. The first and second legs 20 and 21 of the second clamping member extend from the apex 18 at an angle $\theta$ and gradually toward corresponding legs 14 and 15 of the first clamping member 13 so that they eventually overlap the legs of the first clamping member 13. When the material is clipped between the first and second clamping members, the clipping force is produced collectively at the points of overlap. The clipping force acts in a direction substantially perpendicular to the plane of the material being clipped. Further, in the clip 10, the leg 14 of the first clamping member and the leg 21 of the second clamping member are capable of being elastically displaced to either side of the clip. In addition, the legs of the second clamping member intersect the corresponding legs of the first clamping member from the inside and at a gentle angle $\theta$. When the tab 19 of the second clamping member is pushed from the front side in the illustrated state, the leg 21 of the second clamping member and leg 14 of the first clamping member are flexed to the inner and outer sides, so that the second clamping member can be maneuvered through the first clamping member 13. In this way, it is possible to bring the second clamping member to either side of the first clamping member for adjusting the extent of opening between the two rings or for using the clip in the converse form.

Further, this type of clip permits pages of the clipped material to be turned more completely because the clip requires less corner space. Still further, a thick material can be clipped with a strong clipping force because the legs make close contact along the surface of the material.

Figure 4:
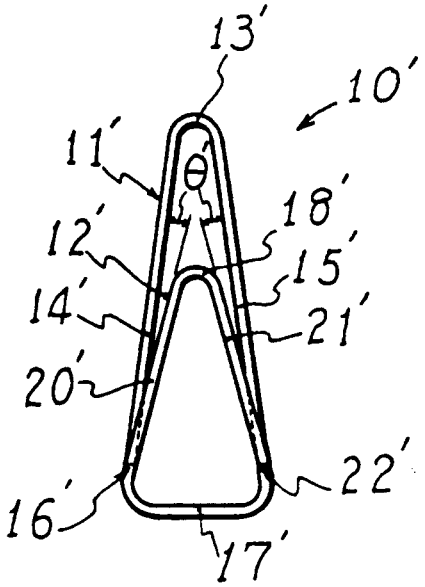
FIG. 4 is a front view showing a different embodiment of the clip according to the present invention.

FIG. 4 shows a different embodiment of the clip 10. In this clip, both the first and second clamping members extend further and resemble what is commonly known used as a V-shaped clip. Its first clamping member 11' has a leg 14' having a cut end 16' and a leg portion 15' having an uncut end united to a connecting rod 17'. The second clamping member 12' has a leg 20' having an uncut end united to the connecting rod 17'. The leg 21' has a cut end 22'. The legs 20' and 21' of the second clamping member extend from the apex portion 18' at an angle $\theta'$ toward the corresponding leg 14' and 15' of the first clamping member so that they eventually overlap the legs of the first clamping member 11'. Again with the clip 10', like the preceding embodiment, the material can be clipped perpendicularly where the clamping members overlap. Further, the second clamping member can be brought to either side of the first clamping member.

In the Gem clip or the like, if the difference in length between the two clamping members is large, a strong clipping force is produced by the cut end of the leg of the second clamping member, and the force provided by the cut end of the first clamping member is weak.

Figure 5:
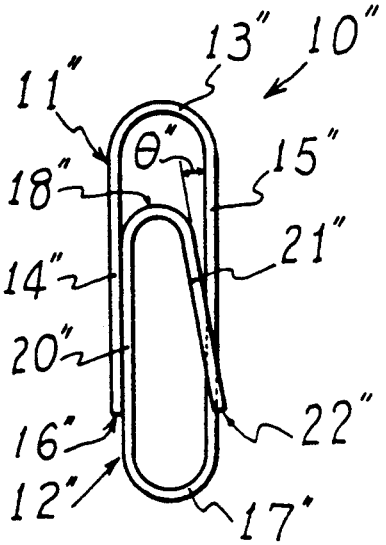
FIG. 5 is a front view showing a further embodiment of the clip according to the present invention.

FIG. 5 shows a further embodiment of the present invention. The clip 10'' shown here resembles what is popularly known as a Gem clip. The first clamping member 11'' has a leg 14'', cut end 16'', and a leg 15'' having an uncut end united to a connecting rod 17''. The second clamping member 12'' has a leg 20'' having an uncut end united to the connecting rod 17'' and a leg portion 21'' having a cut end 22''. The first clamping member has an apex 13'' which is bent into a semi-circle, and parallel legs 14'' and 15'' which extend rearwardly from the apex 13''. The second clamping member has a leg 21'' extending rearwardly from the apex at an angle $\theta''$ toward the leg 15'' of the first clamping member until it eventually overlaps the portion 15''. The leg portion 20'' extends parallel to leg 14'' of the first clamping member. In the clip 10'', in which only one second clamping member leg portion on the cut end side overlaps the first clamping member, the material is strongly clipped between the overlapping legs, and the clipping force between the legs 14'' and 20'' is weak. The long and flexible leg 14'' of the first clamping member provides a weak force that will not bend the clipped material, and there is no noticeable trace of clipping.

In the clip 10 shown in FIGS. 1 to 3, the second clamping member inner 12 has the tab 19, so that the total wire length of the second clamping member is substantially equal to the length of the first clamping member 13. The second clamping member is bent into a wavy form, so that it is more flexible than the first clamping member. Thus, it is possible to have the cut end of the leg 14 of the first clamping member overlap the leg 20 of the second clamping member, and to let the cut end of the leg 21 of the second clamping member extend parallel to the leg 15 of the first clamping member. In this case, the clipping force produced between the legs 15 and 21 are too weak to bend the end of the clipped material, and therefore produce no noticeable trace of clipping. In order to obtain the best performance of the invention, the cut ends of the legs of the inner and outer rings should the corresponding portions of the clip. However, it is possible to obtain a partial effect by having merely the rear portion of only the single leg portion overlap a corresponding portion.

According to the present invention, the sectional profile of the wire is not limited to be circular, but the wire may have any other sectional profiles such as triangular, rectangular or hexagonal sectional profile.

POSSIBILITY OF INDUSTRIAL UTILIZATION

As has been described in the foregoing, the clip according to the present invention can not only be used in the same way as the prior art Gem clip, but it can also maintain the appearance of clipped material such as document for the end of the clipped material is not bent. Particularly, the clip according to the present invention is useful for clipping business documents and cards, ends of which are not desired to be bent.

I claim:

1. A clip comprising:

a first clamping member having a first leg and a second leg, the first leg and the second leg being connected at one end;

a second clamping member having a first leg and a second leg, the first leg and the second leg being connected at one end and diverging therefrom;

said first clamping member and said second clamping member being connected, said second clamping member superposed on said first clamping member to form a clip; and at least one of the legs of said first clamping member overlapping the respective leg of said second clamping member, said at least one leg terminating short of a respective end of said respective leg of said second clamping member and defining an acute angle therewith for allowing facile superpositioning of the second clamping member on the first clamping member.

2. The clip according to claim 1, wherein the first clamping member is formed in an inverted V-shape with a rounded apex.

3. The clip according to claim 2, wherein the apex of said first clamping member comprises an angle of between 45° and 90°.

4. The clip according to claim 2, wherein the apex of said first clamping member comprises an angle of less than 45°.

5. The clip according to claim 1, wherein the legs of said first clamping member diverge, and the legs of the second clamping member diverge at a greater angle than the legs of the first clamping member.

6. The clip according to claim 1, further including a tab portion, the first leg and second leg of said second clamping member connecting the tab portion on opposing sides and diverging therefrom.

7. The clip according to claim 6, wherein the legs of said first clamping member diverge, and the legs of the second clamping member diverge from the tab portion at a greater angle than the angle of divergence of the legs of the first clamping member.

8. The clip according to claim 6, wherein the length of the perimeter of the first clamping member is substantially equal to the length of the combined perimeters of the second clamping member and tab portion.

9. The clip according to claim 6, wherein the tab portion is formed in a U-shape to provide a finger-hold.

10. The clip according to claim 6, wherein the first clamping member is formed in an inverted V-shape with a rounded apex.

11. The clip according to claim 10, wherein the apex of said first clamping member comprises an angle of between 45° and 90°.

12. The clip according to claim 10, wherein the apex of said first clamping member comprises an angle of less than 45°.

13. A clip comprising:

a first clamping member having a first leg and a second leg, the first leg being connected to the second leg at one end and diverging therefrom to form an apex, the other end of the second leg being connected to one end of a connecting rod;

a second clamping member having a first leg, a second leg, and a tab portion, a distal end of the first leg and a distal end of the second leg being coupled to opposing sides of said tab portion, said tab portion extending longitudinally in a proximal direction from said distal ends of said first and second legs, said first leg and said second leg extending at an angle from a longitudinal axis of said tab portion, the first leg of the second clamping member connecting another end of said connecting rod;

the second clamping member superposed on the first clamping member; and the second clamping member having shorter first and second legs than the first and second legs of the first clamping member, wherein the tab of the second clamping member does not contact the apex of the first clamping member.

14. The clip according to claim 13, wherein the tab of the second clamping member is formed in a U-shape to provide a finger-hold.

15. The clip according to claim 13, wherein the first clamping member is formed in an inverted V-shape with a rounded apex.

16. The clip according to claim 15, wherein the apex of said first clamping member comprises an angle of between 45° and 90°.

17. The clip according to claim 15, wherein the apex of said first clamping member comprises an angle of less than 45°.

18. The clip according to claim 17, wherein the legs of the second clamping member diverge from the tab portion at a greater angle than the apex of the first clamping member.

19. The clip according to claim 13, wherein the length of the perimeter of the first clamping member is substantially equal to the length of the perimeter of the second clamping member.

20. A clip comprising:

a first clamping member having a first leg and second leg connected at one end and disposed in parallel;

a second clamping member having a first leg and second leg connected at one end and extending at an angle from the connection;

the second clamping member superposed on the first clamping member;

the first leg of the second clamping member parallel to the first and second legs of the first clamping member; and the second leg of the second clamping member overlapping the second leg of the first clamping member and contacting said second leg of the first clamping member at one end.

* * * * *